United States Patent [19]

Helinski

[11] Patent Number: 4,722,622

[45] Date of Patent: Feb. 2, 1988

[54] DAMPING APPARATUS FOR A PRINT HAMMER MECHANISM

[75] Inventor: Edward F. Helinski, Johnson City, N.Y.

[73] Assignee: International Business Machines Corporation, Armonk, N.Y.

[21] Appl. No.: 920,639

[22] Filed: Oct. 20, 1986

[51] Int. Cl.[4] ..... B41J 7/30

[52] U.S. Cl. ..... 400/167; 101/93.02; 101/93.48; 400/457

[58] Field of Search ..... 101/93.02, 93.48; 400/167, 457

[56] References Cited

U.S. PATENT DOCUMENTS 4,603,985 8/1986 Helinski et al. ..... 101/93.02 X
4,613,243 9/1986 Rossi et al. ..... 400/167 X

FOREIGN PATENT DOCUMENTS 2061155 12/1979 Fed. Rep. of Germany ... 101/93.48
0028878 3/1981 Japan ..... 101/93.48

*Primary Examiner*—Edgar S. Burr

*Assistant Examiner*—Joseph McCarthy

*Attorney, Agent, or Firm*—John S. Gasper

[57] ABSTRACT

Damping apparatus for minimizing print hammer settle time permits an increase in the hammer repetition rate, and in which the damping element is a reactive mass which is freely movable behind the actuated element to effect one or more energy transfer collisions with the actuated element. A return spring applies a return force to restore the actuated element and the reactive mass to a rest position. A bias spring, having an applied spring force which is lower than the return spring moves the reactive mass at a slower rate than the actuated element to cause the actuated element to collide with the reactive mass in advance of the rest position whereby the rebound energy of the actuated element is dissipated and restoration of the actuated element can occur as a result of the restore force applied by the return spring. In one embodiment, the reactive mass comprises a backstop assembly movable from the rest position by a spring and comprises a pair of relatively movable damping masses coupled by resilient energy absorbing material.

15 Claims, 9 Drawing Figures

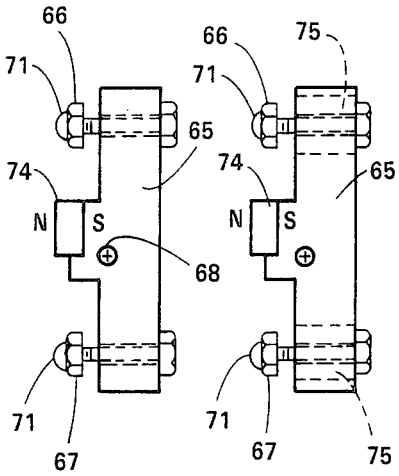
FIG. 5
FIG. 6
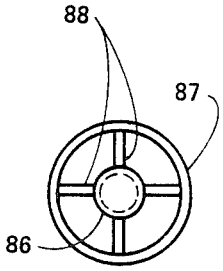
FIG. 9
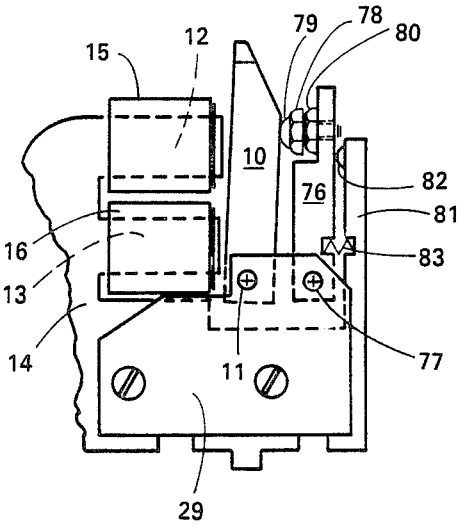
FIG. 7
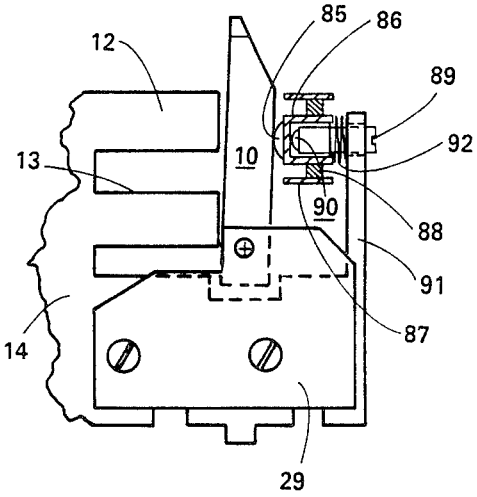
FIG. 8

DAMPING APPARATUS FOR A PRINT HAMMER MECHANISM

FIELD OF THE INVENTION

This invention relates to print hammer mechanisms and particularly to damping apparatus for quickly settling print hammer mechanisms.

BACKGROUND OF THE INVENTION

In impact printing, the repetition rate of the print hammer mechanism is limited by the time it takes the hammer mechanism to come to rest, i.e. to settle at its initial or rest position, after printing impact occurs. This has been a long standing problem particularly with inertial type print hammers. In such mechanisms, a print hammer or other impact element is propelled in free flight at high velocity to effect printing on a print medium which may consist of ink ribbon and paper. The resulting impact causes the hammer to rebound with a substantial portion of the original kinetic energy which must be dissipated to bring the hammer to rest. Both registration and print density are adversely affected if the actuated elements of the hammer mechanism are not settled and restored to their rest position before the next printing operation occurs. A subsequent hammer mechanism operation prior to settling varies both the magnitude and timing of the transmitted impact force so that variable density and misregistration result in the print.

Shorter settling times require rapid removal of rebound kinetic energy from the print mechanism. Various solutions have been proposed in the past. They are generally complex, expensive, ineffective or too slow.

One technique has been to have the rebounding hammer mechanism elements strike against a backstop comprised of energy absorbing materials, such as elastomers or butyl rubber, and against which the rebounding elements can come to rest. Prominent disadvantages are that the settling time is not radically shortened and, after the energy absorbing material receives repeated beating, it changes its energy absorption characteristics and dimensions. Eventually the original rest or home position of the print mechanism is changed and adjustment or replacement of all or part of the print mechanism is required to maintain good print quality. Examples of such mechanisms are shown in U.S. Pat. Nos. 3,241,480; 3,675,172 and 4,496,253.

Another technique has been to apply a frictional drag to the hammer element as in U.S. Pat. Nos. 4,329,921 and 2,696,782 but this causes undesired rapid wear of the components.

A different method has been to trap or block the rebounding hammer as it returns from impact with the type, such as shown in U.S. Pat. Nos. 3,143,064, 2,696,782 and 2,353,057. In a further arrangement, a print hammer carries a freely movable weight which is impelled against the hammer as a result of the hammer impacting the type and again when the hammer is arrested at its home position. While this arrangement prevents the hammer from making a second impression, it does not prevent the hammer from rebounding off the backstop and does not appreciably reduce settle time. Furthermore, greater energy must be expended to operate the hammer as a consequence of the added weight carried by the hammer. Examples of this arrangement are shown in U.S. Pat. Nos. 2,616,366 and 2,625,100.

SUMMARY OF THE INVENTION

Rapid settling of a print hammer mechanism is obtained by providing a damping element between the actuated element and the stop position. The damping element is disengaged from and moves from the stop position as the actuated element is operated to perform printing. As a consequence the damping element is in position to engage the rebounding actuated element in one or more collisions and alternately with the actuated element and a stop element. The damping element in one embodiment comprises a pair of relatively movable reactive masses coupled by energy absorbing material. The energy absorbing material comprises pads connected between the reactive masses in both a shear and compression/tension coupling arrangement. Preferably the ratio of the effective mass of the damping element to the actuated element causes the damping element to rebound on collision with the actuated element without causing the actuated element to reverse direction during its rebound.

BRIEF DESCRIPTION OF THE DRAWINGS

FIGS. 5 and 6 are further modifications of the damping elements that can be used in the embodiment shown in FIG. 4;

FIG. 7 is an elevation view of a further modification of the actuator portion of the hammer mechanism of FIG. 1;

FIG. 8 is an elevation view, partially in section, of yet another modification of a damping element that can be used in the mechanism of FIG. 1;

FIG. 9 is a front elevation view of the damping element shown in FIG. 8.

DESCRIPTION OF THE PREFERRED EMBODIMENTS

Figure 1:
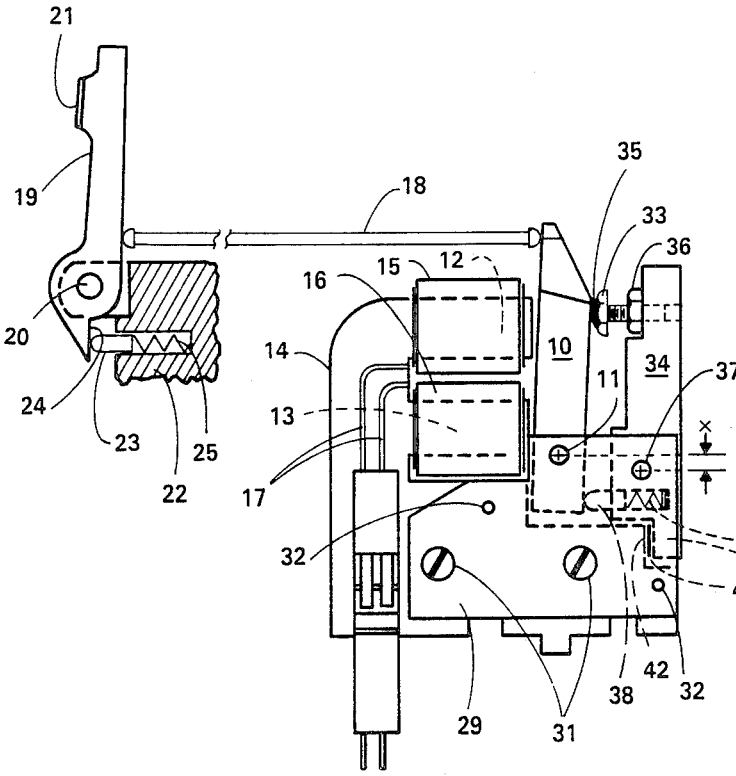
FIG. 1 is an elevation view of a print hammer mechanism incorporating a damping apparatus constructed in accordance with the principles of the invention.

FIG. 1 shows a three piece print hammer mechanism of the inertial type and comprises hammer element 19, push element 18 and an electromagnetic actuator. The actuator comprises magnetic armature 10, magnetic core 14 having poles 12, 13 and energizing windings 15, 16. Drive pulses for energizing windings 15, 16 for operating the hammer mechanism are supplied by circuitry of any well known type, not shown, through an electrical connector to conductors 17.

Hammer element 19 rotates on pin 20 supported by machine frame 22. An impact surface 21 of hardened material near the end of the upper arm of hammer element 19 is aligned with a type carrier for printing. A return spring 25 has a plunger 23, both within a recess in frame 22, bearing on the lower arm surface 24 of hammer element 19 below pivot 20. Return spring 25 is maintained under partial compression to apply a bias force continuously urging hammer 19 to rotate clockwise around pivot 20 to the rest position.

Push element 18 is slidable within a guide, not shown, and has opposite ends in abutting engagement with the upper end of armature 10 and hammer element 19 above pivot 20.

Armature 10 is rotatable on pivot pin 11 supported by side plates 29, 30 attached to core 14 by screws 31. Pins 32 through side plates 29, 30 and core 14 are provided to maintain operational alignment.

As shown in FIG. 1, the hammer element 19 and armature 10 are in the rest or restored position. The rest position is established by a backstop assembly which, according to this invention, is also a damping means for the hammer mechanism. In the embodiment of FIG. 1, the backstop assembly takes the form of lever 34 pivotally mounted by pivot pin 37 between mounting plates 29, 30. A bumper screw 33 extends from upper arm of lever 34 and has a pad 35 of energy absorbing material for contacting armature 10. A suitable material for pad 35 is an elastomer such as polyurethane. A threaded connection with lever 34 enables the extension of bumper screw 33 to be varied for adjusting the rest position of armature 10 and hammer element 19. Lock nut 36 holds the bumper screw 33 against rotation caused by vibration. Lever 34 has a tail portion 40 that aligns with a stop surface 42 formed in core 14 between plates 29, 30. A thin film 41 of polyurethane or other energy absorbing material is carried by tail portion 40 for engagement with surface 42. Alternatively, film 41 may be affixed to stop surface 42. Partially compressed spring 39 and plunger 38, both within a recess in the lower arm of lever 34 apply a bias force continuously urging armature 10 to rotate clockwise on pivot pin 11 and lever 34 to rotate counterclockwise on pivot pin 37. Spring 39 has a relatively low spring force compared to spring 25 whereby spring 25 operating on hammer 19, push rod 18, armature 10, and lever 34 overcomes the bias force of spring 39 and maintains armature 10 in engagement with pad 35 on bumper screw 33 and retains tail portion 40 of lever 34 in engagement with stop shoulder 42 when the system is settled and in the rest position.

Separating pivots 11 and 37 by the dimension x causes an imbalance of the bias force of spring 39 on armature 10 and lever 34 so that both are urged to rotate clockwise. With the arrangement shown, spring 39 acts with spring 25 to return armature 10 and lever 34 to the rest position. The compression of spring 39 between armature 10 and lever 34 also serves to take up any bearing slack at the pivot pins 11 and 37.

In operation, armature 10 is suddenly attracted to poles 12 and 13 by energizing coils 15 and 16 with drive pulses applied to conductors 17. Armature 10 thereby rotates counterclockwise on pivot 20. Preferably coils 14 and 15 are energized with high amplitude short duration current pulses at a rate which increases the rate of armature acceleration until such time as it is arrested abruptly by impacting the poles 12, 13 of core 14. During the rotation of armature 10 around pivot 11, push element 18 is being displaced to the left. Hammer element 19 at the same time is being rotated in the counterclockwise direction around its pivot 20 against the bias force of spring 25 causing spring 25 to be further compressed by force applied by surface 24 against plunger 23. At the instant armature 10 is arrested by poles 12 and 13, armature 10, push element 18 and hammer 19 were traveling together. The momentum of push element 18 and hammer 19 at the moment armature 10 is arrested is sufficient to continue movement to a point of impact with type to effect printing. The push element 18 may continue movement in contact with the hammer to the point of impact or may become separated as a result of friction with the guide or by some structure limiting its leftward translation. In either case the energy level of hammer 19 is sufficient to cause it to rebound on impact at a very high speed toward the arrested armature. Preferably the current drive pulses will have ended and coils 15, 16 will have been de-energized before the rebounding hammer 19 brings push element 18 into reengagement with armature 10. However, armature 10 will be held in its arrested position by residual magnetism in core 14. As a result, the impact of push element 18 on armature 10 during rebound of hammer 19 causes armature 10 to break away with some slight dissipation of rebound kinetic energy in hammer 19.

The rapid acceleration imparted to armature 10 when coils 15 and 16 are energized results in armature 10 becoming disengaged from bumper 35 thereby freeing lever 34 for unrestricted counterclockwise rotation on pivot 37. Armature 10 also increases the compression on spring 39. The force provided by spring 39 causes lever 34 to begin rotation counterclockwise around pivot 37. However, because of the relatively low spring force exerted by spring 39, lever 34 moves at a relatively low velocity thereby maintaining pad 35 disengaged from armature 10. The counterclockwise rotation of lever 34 also results in tail portion 40 becoming disengaged from stop surface 42 of core 14. Because of the relatively low velocity induced in lever 34 by spring 39, lever 34 will have moved only a small portion of its permissible unrestricted travel toward the activated armature 10 when print hammer 19 and push element 18 rebound and reengage armature 10. This starts armature 10 rotating clockwise as a result of the rebound kinetic energy transferred to it by the rebounding hammer 19. The clockwise rotation of armature 10 reduces the compression on spring 39 thereby reducing the acceleration which caused the counterclockwise rotation of lever 34. The counter motions of armature 10 and lever 34 produce a collision whereby most of the kinetic energy present in armature 10 is transferred to lever 34. This action results in the slowing or stopping of armature 10 before it reaches its rest position. The collision between armature 10 and pad 35 on lever 34 also results in lever 34 changing direction and rebounding from armature 10 toward its rest position where a second collision occurs between tail portion 40 against film 41 on stop shoulder 42 thereby dissipating much of the energy transferred to it from armature 10. Following the initial collision with pad 35, armature 10, without reversing direction, resumes or continues its clockwise rotation in response to the continuous urging by spring 25 and further impacts of hammer 19 through push element 18. However, lever 34 may rebound from the collision of tail portion 40 with stop shoulder 42 thereby recolliding with armature 10 at greatly reduced energy level causing additional energy dissipation of rebound energy in armature 10 and allowing the bias force of spring 25 on hammer 19 to dominate and force armature 10 and lever 34 to settle at their respective rest positions in readiness for the next operation. The alternate collisions and rebounding of lever 34 between armature 10 and stop shoulder 42 in combination with the non-reversable rotation of armature 10 produces rapid removal of hammer rebound energy and achieves rapid hammer settling.

Lever 34 can have an effective mass either less or greater than armature 10 but maximum slowing or actual stopping of the armature on the initial collision is obtained when the ratio of the effective masses of lever 34 to armature 10 is equal to or slightly less than unity. In the preferred embodiment, the ratio of the effective masses is between 1.0 and 0.5. In addition to insuring rapid settling, via efficient transfer of energy from armature 10 to lever 34, there is an assurance with the range of mass ratios specified, that settling is not delayed by causing armature 10 to reverse direction during rebound. While elastomer pad 35 and film 41 along with spring 39 absorb some energy from the system, pad 35 and film 41 can be relatively thin so that the amount of energy absorbed by them can be relatively small and within their ability to absorb the shock of the collisions without becoming distorted. This is an advantage over known arrangements where thicker pads of compressible energy absorbing materials located at fixed stop positions are used.

Figure 2:
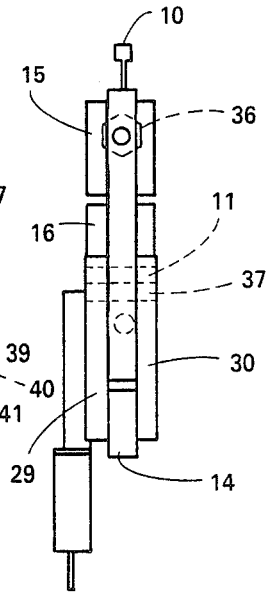
FIG. 2 is an end view of the print hammer mechanism illustrated in FIG. 1.
Figure 3:
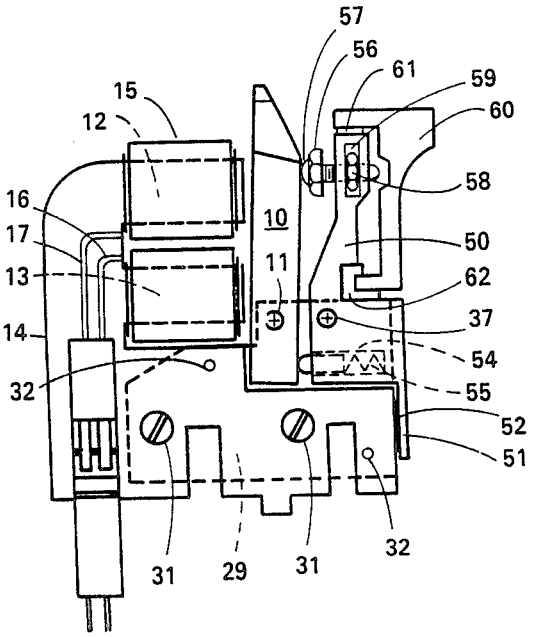
FIG. 3 is an elevation view of a modification of the hammer mechanism of FIG. 1 showing a second embodiment of a damping apparatus incorporating the principles of the invention.

A modification of an electromagnetic actuator showing a second embodiment of the invention is described in FIG. 3. In the description, like reference numbers are used to identify identical elements of FIGS. 1 and 2.

In the embodiment shown in FIG. 3, the damping means is a movable backstop assembly that uses two relatively movable damping masses, designated primary and secondary masses, coupled in a damping arrangement by energy absorbing material. As shown in FIG. 3, the primary damping mass is a lever 50 that rotates about pivot pin 37 and has a tail portion 51 engaging a thin elastomer pad 52 between it and a stop surface on the edge of core 14. A plunger 53 extends from drilled opening 54 under the influence of compression spring 55 and engages armature 10 so that the lever 50 and armature 10 are urged in opposite rotational directions about their respective pivots. Lever 50 also carries adjustable bumper 56 having elastomer pad 57 and lock nut 58 as in the embodiment of FIG. 1. Lock nut 58 is located within a cut out 59 in lever 50. As in the previous embodiment, the spring force of spring 55 is relatively low so that it is readily overcome by the bias force of spring 25 on hammer 19 whereby armature 10 is restored and maintained in contact with pad 57 and tail portion 51 is in contact with film 52 when settled at the rest position. A secondary damping mass 60 is supported on lever 50 and is resiliently coupled thereto by pads 61 and 62 of energy absorbing material. Pads 61 and 62 are preferably an elastomer such as butyl rubber and attachment to lever 50 and mass is by adhesive bonding or vulcanization. The effective mass of the backstop assembly may be greater or less than the effective mass of armature 10 but preferably the ratio is unity or less. This assures that the backstop assembly will rebound upon collision with armature 10 without causing armature 10 to rebound in the counterclockwise direction.

Likewise, the ratio of the secondary damping mass 60 and the effective mass of lever 50 is preferably equal to unity. However, this ratio is not critical and can vary so long as the effective mass of the total backstop assembly is equal to or less than unity so that armature 10 does not rebound upon collision with the backstop assembly.

In operation, armature 10 accelerates rapidly in the counterclockwise direction when activated. Lever 50 is thereby freed to rotate in response to the bias force exerted on lever 50 by the compressed spring 55. Rotation of lever 50 is in the same direction as but at a slower rate than armature 10. As a consequence, armature 10 becomes disengaged from pad 57 of bumper 56 and tail portion 51 becomes disengaged from film 52 on the stop surface of core 14 and the backstop assembly will have moved a small portion of its permissible unrestricted travel in position for a collision engagement with armature 10. As in the previous embodiment, the clockwise rotation of armature 10 caused by the rebounding hammer 19, after windings 15 and 16 are de-energized, reduces the compression of spring 55 thereby reducing the counterclockwise acceleration of lever 50 and its supported elements. As previously described, clockwise rotating armature 10 collides with pad 57 of the slow moving or stopped backstop assembly when tail portion 51 is at a short distance from the stop surface of core 14 causing the backstop assembly to rebound and move in the clockwise direction. The collision and rebounding of the backstop assembly severely slows or, depending on the ratio of the effective masses, temporarily stops armature 10 without causing it to rebound in the counterclockwise direction. In addition, the collision causes a reactive damping to occur in the backstop assembly. This reactive damping occurs as a result of the out of phase motion of mass 60 relative to lever 50 and the damping produced by the shear and compression of pads 61 and 62. The relative motion of the damping masses occurs when armature 10 collides with lever 50. This causes lever 50 to be arrested and reverse its rotation. The reverse rotation of lever 50 is temporarily opposed by the inertia or momentum of damping mass 60 supported by pads 61 and 62. Because of this relative motion, pad 61 is subjected to shear stresses and pad 62 is subjected to compression stresses which serve to absorb substantial additional energy transferred to the backstop assembly by armature 10. On rebounding from the collision and rotating clockwise toward the rest position, tail portion 51 of lever 50 collides with the stop surface of core 14 thereby abruptly halting further rotation of lever 50. In this case, damping mass 60 continues in motion limited only by the degree permitted by pads 61 and 62. Again pad 61 is subjected to shear stresses, but in the opposite direction and pad 62 is subjected to tension stresses the effect of which is again to damp additional energy transferred to the backstop assembly from armature 10. An additional effect of the shear and compression coupling of lever 50 and mass 60 is to produce a reactive damping which is out of phase with any shock energy transmitted by armature 10. This assures that both armature 10 and the backstop are quickly settled for return to the rest position by spring 25.

Figure 4:
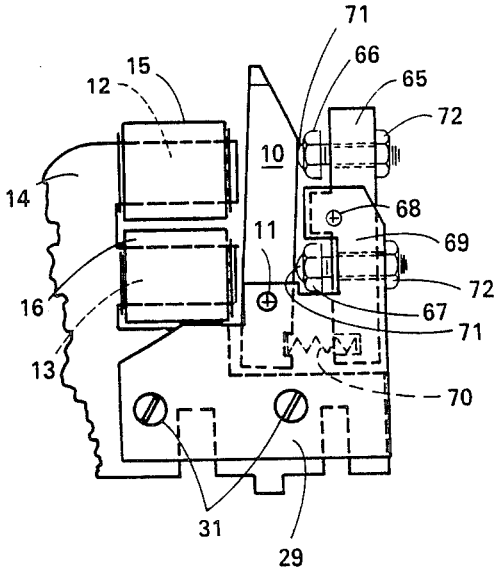
FIG. 4 is an elevation view of another hammer mechanism showing another embodiment of a damping apparatus incorporating the principles of the invention.

Another modification of the actuator damping mechanism is shown in FIG. 4 in which the reactive mass damping is performed by a pivoted lever to produce multiple impacts on the rebounding armature. In this embodiment, the reactive mass is an assembly of lever 65 carrying a pair of bumpers 66, 67 with lever 65 being pivotally mounted on pin 68 supported on fixed extension 69 on side plates 29 and 30. Spring 70 retained in suitable recesses in the lower portions of lever 65 and armature 10 and maintained under compression by the larger force of the return spring 25 (FIG. 1) urges actuator 10 and lever 65 to rotate in opposite directions about respective pivots 11 and 68. Bumpers 66 and 67 each having a thin layer of energy absorbing elastomeric material 71, are threadedly mounted in lever 65 and secured with a lock nut 72.

In operation, the energization of windings 15 and 16 rapidly accelerates armature 10 counterclockwise thereby freeing lever 65 for relatively slow counterclockwise rotation by the force exerted by spring 70.

The rebounding armature 10 first impacts bumper 66 which in rebounding causes lever 65 to rotate clockwise. The rotation of lever 65 causes bumper 67 to impact armature 10 and then rebound to thereby rotate lever 65 counterclockwise to effect a second impact between bumper 66 and armature 10. The process continues with decreasing force on the bumpers and causes the rebound energy of armature 10 transmitted to it by hammer 19 to be quickly absorbed as the armature continues movement toward its rest position where it is in engagement with both bumpers. The effective mass of lever 65 with bumpers 66 and 67 is preferably approximately the same as the effective mass of armature 10 and causes armature 10 to severely slow or momentarily stop during its return to the restored rest position. An advantage of this arrangement is that the rebounding forces of the reactive mass are delivered directly to the armature and not to a stop surface of another element such as core 14.

Modifications of the reactive mass lever 65 are shown in FIGS. 5 and 6. In FIGS. 5 and 6, a magnet 74 is attached to lever 65 and establishes an armature return force and rotation biasing forces for lever 65. The rotational biasing by magnet 74 assures that both bumpers 66 and 67 will not be struck simultaneously by the rebounding armature 10. In FIG. 6, elastomeric inserts 75 have been added in which bumpers 66 and 67 have been mounted. The inserts act in shear and provide added damping between lever 65 and the bumpers.

In the embodiment of FIG. 7, reactive mass lever 76 is pivoted on pin 77 supported in side plates 29, 30. The lever carries bumper 78 with pad 79 of thin elastomeric material and over lock nut 80. Magnetic core 14 has an extension 81 thereon carrying a thin pad 82 of elastomeric material and a light compression spring 83 between extension 81 and lever 76 urging lever 76 to rotate counterclockwise about its pivot 77. Hammer return spring 25, however, maintains both armature 10 and lever 76 at their clockwise limit when in the settled state. When the armature 10 is rapidly attracted counterclockwise, lever 76 moves in the same direction at a slower rate. Subsequent hammer rebound, as previously described, causes the armature to engage the oppositely moving lever and bumper so that its loss of kinetic energy ensues. Both bumper 78 and pad 82 absorb energy from the system through impacts of increasing magnitude to all smooth return of the armature and lever to the restored rest position at the clockwise limits.

FIGS. 8 and 9 illustrate a further modification of a reactive mass damping system for a print hammer actuator. In this arrangement, the armature 10 pivots about shaft 11 and is urged to the right by a print hammer spring and push element as in FIG. 1. In its rest position, armature 10 engages pad 85 of clastomeric material carried on a thimble-shaped hub 86 having supported thereon a rim 87 by radial spokes 88 of elastomeric material. On its inner surface hub 86 is slidingly supported by a post 89 having a pad 90 of elastomeric material for engaging the inner end surface of the hub. The post 89 is adjustably threaded into an extension 91 of magnetic core 14, and a light spring 92 on post 89 urges hub 86 toward armature 10 away from magnetic core extension 91. In the restored position, however, hammer spring 25 (FIG. 1) is able to overcome spring 92 and urge armature 10 and hub 86 to their right hand limit.

During operation, armature 10 is attracted suddenly against poles 12 and 13 to drive push rod and hammer to the printing position. This allows spring 92 to slide hub 86 with attached rim 87 and spokes 88 toward the left at a slower rate. When print hammer 19 rebounds to disengage armature 10 from the residual magnetic holding force, armature 10 engages pad 85 and hub 86 with attached rim 87 at a position where there is a space between pad 90 on the end of post 89 and the inner end surface of hub 86 so that rebound energy is absorbed and transferred rapidly thus slowing armature and hammer. The original direction of the hub and rim assembly is reversed and it then engages pad 90 on post 89 compressing spring 92. Energy is absorbed by the elastomeric pads and spokes 88 and the peripheral rim mass counteracts the armature and hammer. The resiliently mounted rim provides an out-of-phase reactive mass and the energy absorbing spokes 88 rapidly damp the hammer and armature motion.

It will be seen from the foregoing embodiments and description that new and novel apparatus has been discovered that quickly suppresses print hammer rebound motion and enables a faster print repetition rate. The invention is particularly energy efficient by not requiring the activating force for printing to also accelerate the reactive mass as in the known art. The disclosed embodiments are easily implemented in printing apparatus and do not require complex manufacturing or assembly. It will be noted that the damping arrangement can also be adapted directly to a print hammer when it also serves as the actuator directly, without the added components of push element and armature.

Since the reactive elements respond proportionately to the activating source, each energy reaction is a predictable fraction of the initial action thereby providing the required energy dissipation regardless of the usual energy variations imparted by the active source. Only the required response is imparted. Because of this, the print actuator assembly can accommodate a range of activating energies applied to the activator or armature.

While the novel features of the present invention have been shown and described with reference to preferred embodiments thereof, it will be understood by those skilled in the art, that the foregoing and other changes can be made in the form and details without departing from the spirit and scope of the invention.

What is claimed is:

1. Apparatus for damping the rebound motion of an actuated element of a print hammer mechanism used in printing data on a print medium, said actuated element being movable away from a rest position, said apparatus comprising a damping element located between said actuated element and a fixed stop;

said fixed stop defining the rest position of said actuated element;

said damping element being mounted for free bidirectional movement between said actuated element and said fixed stop, means causing said damping element to move away from said fixed stop upon actuation of said actuated element, said actuated element impacting said damping element during movement of said actuated element toward said rest position and while said damping element is out of contact with said fixed stop whereby said damping element engages said actuated element and said fixed stop in alternate energy transfer collisions during said rebound motion of said actuated element toward said rest position;

said damping element and said actuated element having a mass ratio whereby said damping element will rebound toward said rest position as a result of a collision with said actuated element without reversing the direction of said rebound motion of said actuated element; and energy absorbing means for damping the oscillations of said damping element resulting from said alternate collisions.

2. Apparatus in accordance with claim 1 in which said mass ratio is substantially equal to or less than unity.

3. Apparatus in accordance with claim 1 in which said mass ratio is between 0.5 and 1.0.

4. Apparatus in accordance with claim 1 in which said damping element comprises a first damping mass movable for engaging said actuated element and said fixed stop in said alternate collisions and said energy absorbing means comprises a second damping mass carried by said first damping mass;

said second damping mass being movable relative to said first damping mass in reaction to said alternate collisions by said first damping mass to effect damping of said oscillations of said damping element resulting from said alternate collisions.

5. Apparatus in accordance with claim 4 in which said energy absorbing means further comprises energy absorbing material coupling said first and second damping masses and coacting therewith to effect damping of said oscillations of said damping element.

6. Apparatus in accordance with claim 5 in which said energy absorbing material is a visco-elastic material.

7. Apparatus in accordance with claim 6 in which said visco-elastic material is an elastomer.

8. Apparatus in accordance with claim 5 in which said energy absorbing material has first and second coupling portions, said first coupling portion forming a shear coupling, and said second coupling portion forming a compression/tension coupling respectively between said first and second damping masses.

9. Apparatus in accordance with claim 4 in which said first damping mass comprises a pivoted member having a first portion carrying said second damping mass and colliding with said actuated element during rebound and a second portion colliding with said stop to thereby cause said relative movement of said second damping mass carried by said first portion of said pivoted member.

10. In a print hammer mechanism having a member movable from a rest position to an actuated position to effect printing of data on a print medium, fixed stop means for defining said rest position, means for applying a restoring force for continuously urging said member toward said rest position, activating means for propelling said member to said actuated position in opposition to said restoring force to effect printing and rebound movement of said member toward said rest position, and means for rapidly settling said member during said rebound movement of said member from said actuated position comprising a damping element mounted for bidirectional damping movement between said member and said stop, said damping element being in simultaneous engagement with said member and said stop when said member is at said rest position;

means for applying a displacement force to said damping element for continuously urging said damping element toward said actuated position whereby said damping element becomes disengaged from said stop element and moves into position in advance of said rest position to alternately engage said member at a position in advance of said rest position and said fixed stop in alternate energy transfer collisions during said rebound movement of said member toward said rest position, and energy absorbing means for damping oscillations of said damping element resulting from said alternate collisions of said damping element with said member and said stop element.

11. In a printing mechanism in accordance with claim 10 wherein said damping element is a lever pivoted for said bidirectional movement to effect said alternate collisions with said member and said fixed stop.

12. In a printing mechanism in accordance with claim 10 in which said damping element has at least one energy absorbing means engageable with said member.

13. In a printing mechanism in accordance with claim 10 in which said damping element has at least two energy absorbing means thereon.

14. In a printing mechanism in accordance with claim 10 in which said means for applying said displacement force to said damping element comprises resilient means urging said damping element toward said actuated position.

15. In a printing mechanism in accordance with claim 14 in which said resilient means comprises spring means compressible between said member and said damping means for applying said displacement force to said damping element.

* * * * *